United States Patent [19]

Westerberg

[11] Patent Number: 4,928,754

[45] Date of Patent: May 29, 1990

[54] HEAT EXCHANGING APPARATUS

[76] Inventor: Anders Westerberg, Gnejsstigen 20, S-951 64 Luleå , Sweden

[21] Appl. No.: 411,457

[22] PCT Filed: Mar. 30, 1988

[86] PCT No.: PCT/SE88/00161

§ 371 Date: Sep. 19, 1989

§ 102(e) Date: Sep. 19, 1989

[87] PCT Pub. No.: WO88/07608

PCT Pub. Date: Oct. 6, 1988

[30] Foreign Application Priority Data

Mar. 30, 1987 [SE] Sweden ..... 8701318

[51] Int. Cl.[5] ..... F28F 17/00; E03B 7/10

[52] U.S. Cl. ..... 165/134.1; 165/71; 165/104.27; 138/27; 137/59; 137/593; 237/80

[58] Field of Search ..... 165/71, 134.1, 104.27; 138/27; 237/80; 137/59, 593

[56] References Cited

U.S. PATENT DOCUMENTS

| | | | |
|---|---|---|---|
| 1,323,955 | 12/1919 | Bohannon et al. . | |
| 2,238,952 | 4/1941 | Stacey, Jr. | 237/80 |
| 2,301,433 | 11/1942 | McElgin | 165/71 |
| 2,954,213 | 9/1960 | Pellegrini | 165/71 |
| 3,319,657 | 5/1967 | Nyiri | 138/27 |

FOREIGN PATENT DOCUMENTS

| | | | |
|---|---|---|---|
| 445238 | 7/1983 | Sweden . | |
| 909479 | 2/1982 | U.S.S.R. | 237/80 |

*Primary Examiner*—Albert W. Davis, Jr.
*Attorney, Agent, or Firm*—Young & Thompson

[57] ABSTRACT

A heat exchanging or circulation apparatus comprising a system of conduits connected to an inlet and an outlet for circulating water or other practically incompressible liquid through the system, heat being transferred through the conduit walls, circulation through the apparatus being periodically shut-off, whereupon continued heat transfer through the conduit walls causes freezing of the liquid to ice in the conduits. Two first portions of the system are relatively heat insulated or shielded from flowing cold air to obtain delayed freezing of the water in these portions in relation to the freezing of the liquid to ice in uninsulated second portions of the system located between the first two portions so that ice growing in the second portions towards the ends thereof will be in communication with the two first portions will result in an increased pressure on the unfrozen liquid in the insulated portions of the system, the increased water pressure being relieved by the two first portions each connected through insulated branch conduits with a closed insulated pressure relief or absorbing means so as to avoid rupture of the conduits in any portion of the system.

10 Claims, 4 Drawing Sheets

HEAT EXCHANGING APPARATUS

The present invention relates to a heat exchanging apparatus for circulating or conducting heated water through conduits swept by air to be heated. The invention relates particularly to improvements of a heat battery in the form of pipes in a duct leading air from outside to inside of a building, and to improvements of radiators.

Installations of water-air heat exchangers of different kinds, heat batteries in air conditioning equipment, ordinary water radiators etc often have problems with pipe ruptures due to freezing in low air temperatures. Attempts to achieve reliable protection against pipe rupture due to freezing in such installations have not been successful so far. The heavily dimensioned pipes have not been able to withstand the heavy compression forces occurring when ice forms in the piping system. Pipe rupture in heat batteries of the type illustrated in FIG. 1 usually occur at the pipe bends, and for preventing freezing of these portions, they have been further insulated against the cold air flowing through the battery. These measures have been unsuccessful, however, for a reason which will be clearly apparent below.

Attempts have also been made to sense the temperature at the places where pipe rupture usually occurs. When the temperature approaches 0° C. at the sensors, the flow rate is automatically increased by a regulating unit. These attempts have also been unsuccessful for the same reason which will be explained below.

Within the industry, these problems with rupture due to freezing have been regarded for some time as more or less insoluble.

The present invention thus has the object of achieving a heat exchanger of the types mentioned above, that is heat batteries and radiators, which is protected against pipe rupture, should ice formation occur in the piping. The heat exchanger should be reliable, maintenance-free and function without electronic or other sensors. This is achieved by a heat exchanger of the type described in the opening paragraph of claim 1 and having the features set forth in the characterizing clause thereof.

The solution which the present invention signifies is partly based on a discovery completely incompatible with the generally accepted understanding as to how pipe rupture during freezing occurs, and on which all the previous attempts to provide a satisfactory solution have been based. Tests carried out by me under controlled conditions in a research laboratory have namely shown that pipe rupture during freezing does not occur at the ice plug formd, but at a part of the pipe where the water is not yet frozen. The pipe rupture customarily occurs due to the increasing pressure in the still unfrozen water due to a growing ice plug somewhere else in the pipe. This explains why temperature-controlled frost-protection means have not been able to solve the problem. It is not possible to measure the temperature everywhere in the circulation system. The pipe rupture occurs where the water is warmest, and it is here that temperature sensors have been placed. Reliable temperature sensing in the unprotected heat-exchanging parts of the pipes is not possible due to the widely varying temperatures between the pipe fin surfaces, which are subjected to flowing cold air and the interior of the pipe. Furthermore, the sensors have a reaction time which is too long in the rapid freezing process.

This situation, that pipe rupture takes place at a part of the pipe where the water has not yet frozen, has avoided discovery due to another scarcely noted property of water, namely that its freezing point falls with increasing pressure. Growing ice plugs increase the pressure in the as yet unfrozen part, simultaneously as the temperature can fall below 0° C. in the still unfrozen water. When the pipe subsequently bursts, the pressure falls suddenly and the freezing point is instantaneously raised to 0° C. again, the water immediately freezing to ice. In most cases the repairman is confronted with a protruding ice plug at the place of rupture, and draws the conclusion that the pipe was poorly insulated at this particularly place since a bursting ice plug has obviously been formed there. This generally accepted "knowledge" as to how pipe rupture occurs has merely led one skilled in the art to solutions, e.g. extra insulation, which have made the problem worse rather than solved it.

Due to this discovery I have been able to attack the problem with a completely different understanding and have achieved a solution which is simple, reliable, completely maintenance-free and easy to apply in existing structures. It has also made it possible to use thinner copper pipes and thereby increase the heat conductive (cold take-up) ability of the uninsulated pipe parts.

The present invention will now be described in greater detail with reference to some examples, illustrated in the accompanying drawings.

FIG. 1 schematically illustrates in cross-section a conventional heat battery provided in a duct for leading cold air from outside to inside a building;

FIG. 2 schematically illustrates the above known heat battery improved in accordance with the present invention;

Figure 1:
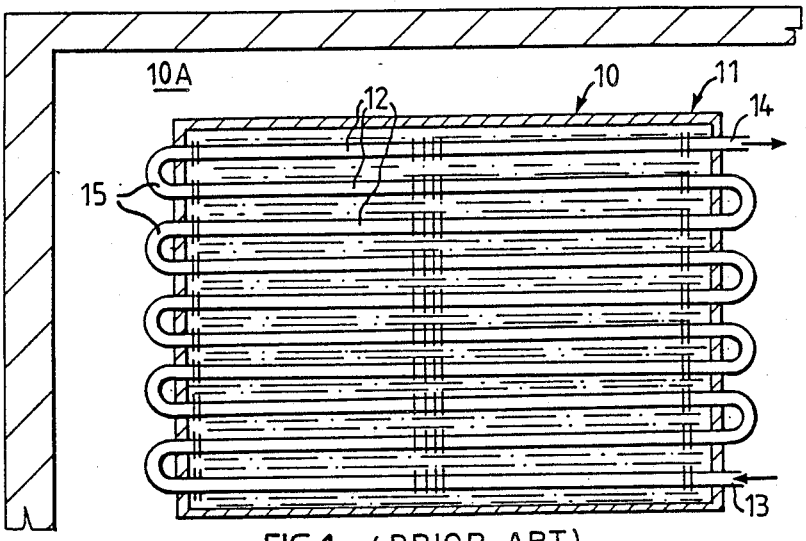
FIG.1 (PRIOR ART)

The conventional heat battery 10 illustrated in FIG. 1 is located in a space 10A in a building and is used in an air conditioning installation for heating fresh outdoor air which is blown by a fan through a duct 11 and past the uninsulated parts 12 of the pipe system, which leads the hot water from a district heating network, heating unit or the like, the hot water entering an inlet 13 and leaving through an outlet 14. The pipe bends 15 are usually not subjected to the cold air and are thus relatively insulated. Should water circulation take place too slowly or completely cease for some reason, ice plugs can be formed in the uninsulated, unprotected pipe parts 12 and rapidly increase the pressure in the insulated pipe bends 15, leading to pipe rupture there. Pipe rupture in the bends can, for example, occur after some few minutes in very cold weather if the circulation pump were to stop and the fan to continue blowing cold air through the installation. Even if the fan is automatically shut down when circulation is poor, the air flows continue due to so-called "downdraft".

Figure 2:
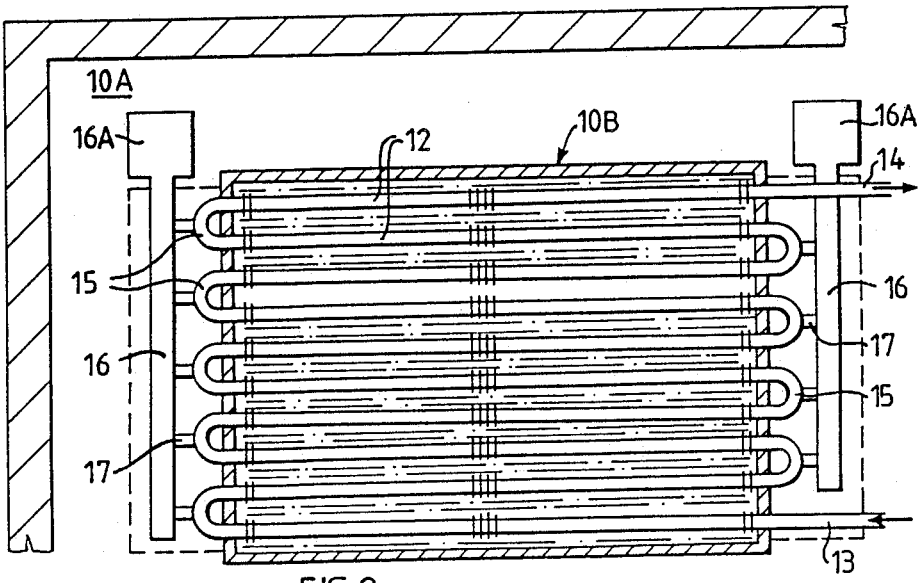

FIG. 2 illustrates a heat battery 10A in accordance with my invention, where each pipe bend 15 is in communication with a collecting chamber 16 and a pressure chamber 16A. The collecting chamber 16 and the branch conduits 17 between this chamber and the pipe bends 15 are heat-insulated. The branch conduits or pipes 17 are restricted to a diameter of only 2–3 mm, in order not to disturb the water circulation in normal operation. The water in the piping system is normally under a pressure of 200 kPa and the air in the pressure chamber 16A is therefore under the same pressure of 200 kPa. If ice plugs are formed in the uninsulated pipe portions 12, the pressure in the pipe bends 15 increases when the ice plugs grow. This pressure is taken up by the compressible air in the pressure chamber 16A and thus prevents the pipe rupture which otherwise would occur. Even if all the water in the heat battery were to freeze to ice, the pressure never goes above 600 kPa, which is far below the rated pressure for ordinary copper pipes. In this connection it is important that the pipe bends 15, the restricted branch conduits 17, the tube-like collecting chamber 16 and the pressure chamber 16A are relatively insulated, to be quite sure that the water there freezes last. The principle of the invention can also be applied to other types of heat exchangers, such as radiators, where the circulation is kept going, although ice plugs have been formed in some of the pipe coils.

It is of course possible within the scope of the invention to use other pressure-relieving means than a pressure chamber with an enclosed gas cushion, e.g. different kinds of safety valves, and to utilize the invention in completely different connections, where pipe rupture due to freezing occurs, e.g. in buried water pipes or pipes in buildings, where the pipes transfer heat to the surrounding soil or air. In such an application of the invention, when the buried pipe is frozen, the ice plug grows in both directions and reaches an area where the water pushed by the ice plug enters a collecting duct connected to a pressure chamber with means permitting the pressure to rise to a predetermined value but well below that value which would result in pipe rupture.

Figure 3:
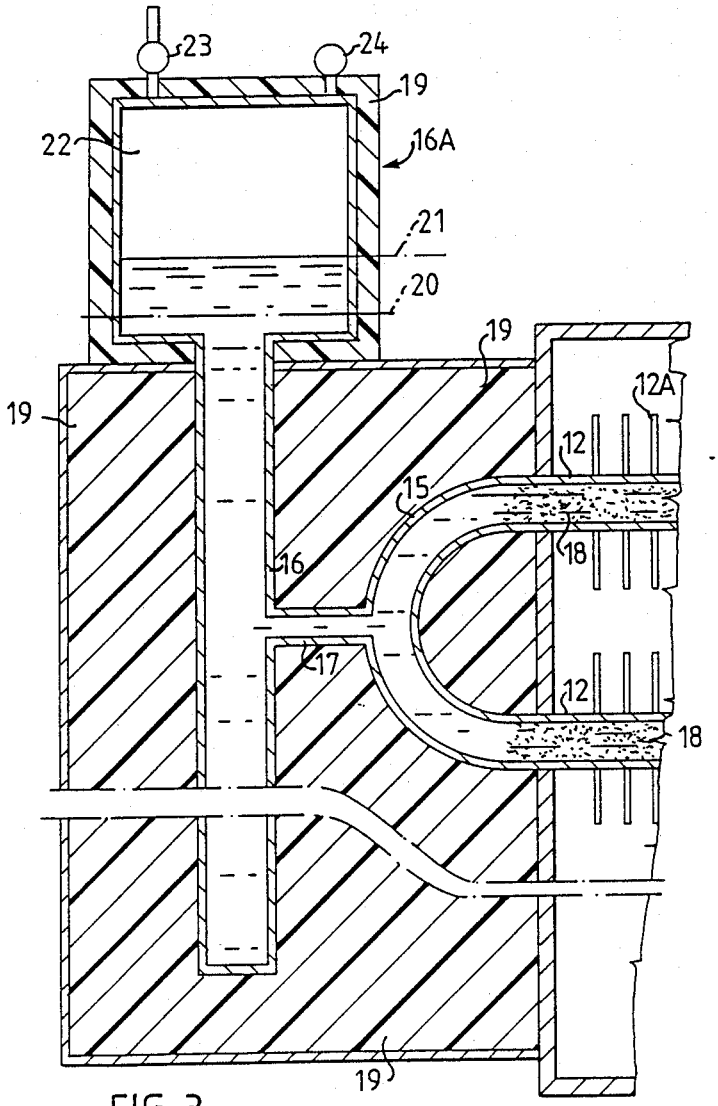
FIG. 3 is an enlarged sectional view of the upper left corner of FIG. 2.

In order to facilitate the understanding of the invention, reference is made to FIG. 3.

The pipes or conduits 12 are provided with flanges 12A.

In both pipes an ice plug 18 is growing towards the pipe bend 15. In known pipe systems this would rapidly increase the pressure of the water in th pipe bend to a value which would result in rupture.

According to the invention, the pipe bends 15, branch pipes 17, the collecting chamber 16 and the pressure chamber 16A are all heat-insulated by means of heat insulating material indicated by reference numeral 19, which will prevent water in these members to freeze. Relative insulation of these elements can also be achieved by simply shielding them from the cold air to which the other pipe surfaces are exposed. Accordingly, the water is allowed to flow slowly under the pushing action from the growing ice plugs 18.

In the pressure chamber the water level rises from the normal level 20 to level 21, which results in a compression of the air in the space 22.

The pressure chamber 16A may be preloaded with a gas under relatively high pressure supplied through a valve 23.

There may also be provided a safety valve 24 which opens at a predetermined pressure.

Alternatively, the pressure chamber 16A may be filled with water, and in this case the safety valve 24 admits water to be discharged at a predetermined pressure.

Figure 4:
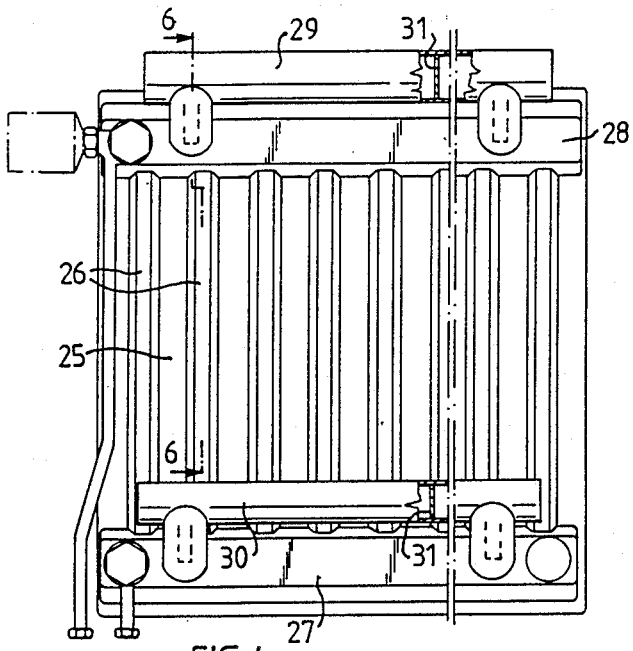
FIG. 4 is a front view of a radiator forming a heat exchanger according to the invention.
Figure 5:
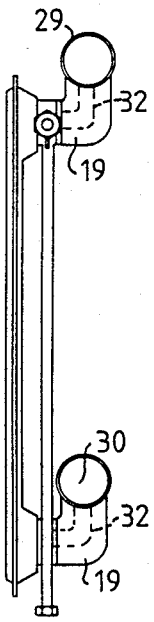
FIG. 5 is an end view of the radiator in FIG. 4.

In FIG. 4 is shown a conventional radiator 25 with vertical water channels 26 connecting a lower collecting chamber 27 with an uppr collecting chamber 28.

An upper pressure chamber 29 and a lower pressure chamber 30 is divided into two compartments by a separating wall 31.

Each of the compartments is connected to the adjacent pressure chamber 29 and 30, respectively, through an insulated branch pipe 32, into which ice plugs 18 may grow and press the water into the chamber 29, thereby preventing rupture of the conduits of the system.

Figure 6:
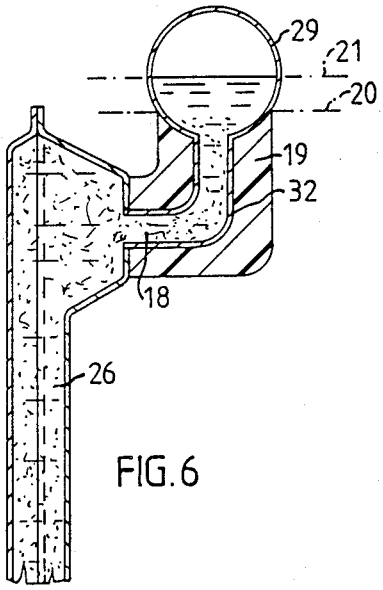
FIG. 6 is an enlarged sectional view according to line 6—6 in FIG. 4 and FIG. 7.
Figure 7:
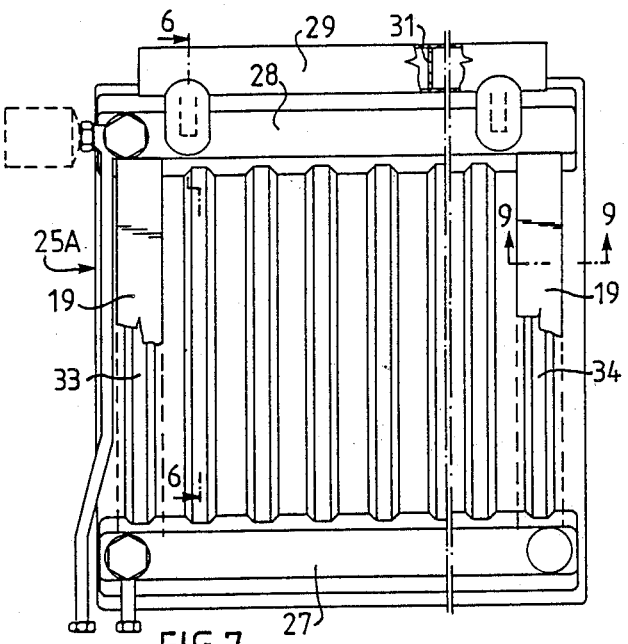
FIG. 7 shows an alternative embodiment of the radiator in FIG. 4.
Figure 8:
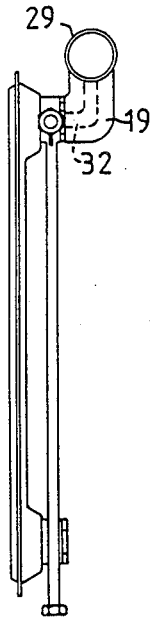
FIG. 8 is an end view of the radiator in FIG. 7.
Figure 9:
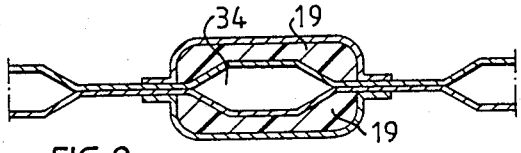
FIG. 9 is an enlarged sectional view according to line 9—9 in FIG. 7.

FIG. 7 shows a modified radiator 25A relative to the radiator in FIG. 6. The lower pressure chamber 30 is omitted, and instead the outermost vertical water channels 33,34 have been heat-insulated by means of heat insulating material 19 as shown in FIG. 9.

Figure 10:
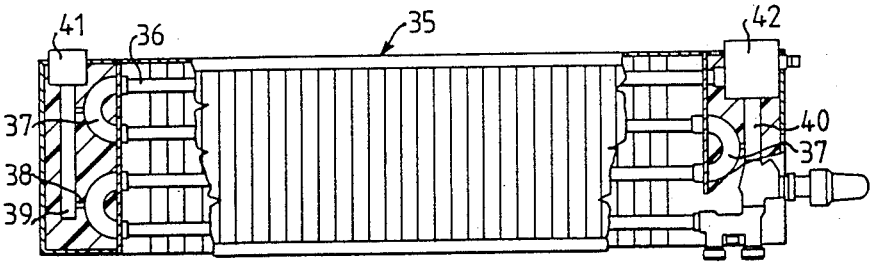
FIG. 10 shows a further alternative embodiment of a radiator as a heat exchanger according to the invention.

FIG. 10 shows another conventional radiator 35 having parallel pipes 36, insulated pipe bends 37, insulated branch pipes 38, insulated collecting chambers 39,40 and insulated pressure chambers 41,42 substantially arranged as in the embodiment shown in FIG. 2.

The heat battery 10A in FIG. 2 and the radiator 25 in FIG. 4 have been tested down to −20° during long and repeated test periods without any rupture in the pipe system. The invention has therefore proved to be very useful and efficient in practice.

I claim:

1. Heat exchanging or circulation apparatus comprising a system of conduits connected to an inlet and an outlet for circulating water or other practically incompressible liquid through the system, heat being transferred through the conduit walls, circulation in said apparatus being periodically shut off, whereupon continued heat transfer through the conduit walls causes freezing of the liquid to ice in the conduits, characterized in that two first portions of said system are relatively heat-insulated or shielded from flowing cold air to obtain delayed freezing of water in said portions in relation to the freezing of the liquid to ice in uninsulated second portions of said system located between said first two portions so that ice growing in said second portions towards the ends thereof being in communication with said two first portions will result in an increased pressure on the unfrozen liquid in said insulated portions of the system, said increased water pressure being relieved by having said two first portions each connected through insulated branch conduits with a closed insulated pressure relief or absorbing means so as to avoid rupture of the conduits in any portion of the system.

2. An apparatus according to claim 1, characterized in that the respective pressure chamber at one end forms an expansion chamber in which a gas volume forms a compressible gas cushion to permit water pushed by the ice in said second portion to enter the expansion chamber under increased counter-pressure from the gas cushion.

3. An apparatus according to claim 2, characterized in that the expansion chamber is preloaded with a gas at a predetermined high pressure above the normal water pressure in the system when it is shut off and before freezing.

4. An apparatus according to claim 1, characterized in that the pressure chamber is provided with a safety valve which opens at a predetermined water pressure to prevent rupture of the conduits.

5. An apparatus according to claim 1, characterized in that the conduit system is provided in a duct for conveying air from outside to inside a building, the conduits being pipes provided with heat exchanging flanges and extending across the duct within the same and being connected with each other through relatively insulated or shielded connecting pipe portions without flanges and lying outside the duct at opposite sides thereof in the air space in the building, each connecting portion at the respective side of the duct being connected to said insulated pressure chamber through said insulated branch conduits.

6. An apparatus according to claim 1, characterized in that said conduits are incorporated in a radiator.

7. An apparatus according to claim 6, characterized in that the radiator has vertical water channels between a lower collecting duct and an upper collecting duct, the upper duct being connected though insulated branch conduits with a pressure chamber.

8. An apparatus according to claim 7, characterized in that the lower collecting duct is connected through insulated branch conduits to a lower pressure chamber.

9. An apparatus according to claim 7, characterized in that the outermost channels connecting the two collecting ducts are heat-insulated to delay freezing to ice therein.

10. An apparatus according to claim 1, characterized in that the conduits are pipes running back and forth in parallel-spaced relationship to form heat exchanging pipes in a radiator, the parallel pipes being pairwise interconnected by insulated connecting portions, which through insulated branch pipes are connected with an insulated pressure chamber.

* * * * *